US012268938B2

(12) United States Patent
Jones

(10) Patent No.: US 12,268,938 B2
(45) Date of Patent: Apr. 8, 2025

(54) GOLF BALLS HAVING REDUCED DRIVER SPIN

(71) Applicant: Acushnet Company, Fairhaven, MA (US)

(72) Inventor: Douglas E. Jones, Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/105,267

(22) Filed: Feb. 3, 2023

(65) Prior Publication Data

US 2024/0261640 A1 Aug. 8, 2024

(51) Int. Cl.
*A63B 37/06* (2006.01)
*A63B 37/00* (2006.01)

(52) U.S. Cl.
CPC ..... *A63B 37/0063* (2013.01); *A63B 37/0033* (2013.01); *A63B 37/0051* (2013.01); *A63B 37/0064* (2013.01); *A63B 37/0065* (2013.01); *A63B 37/0076* (2013.01); *A63B 37/0027* (2013.01); *A63B 37/0096* (2013.01)

(58) Field of Classification Search
CPC ..... A63B 37/0076; A63B 37/0063; A63B 37/0065
See application file for complete search history.

(56) References Cited

U.S. PATENT DOCUMENTS

| | | | | |
|---|---|---|---|---|
| 6,677,401 | B2 | 1/2004 | Boehm et al. | |
| 6,756,436 | B2 | 6/2004 | Rajagopalan et al. | |
| 6,774,187 | B2 | 8/2004 | Voorheis et al. | |
| 6,982,301 | B1 | 1/2006 | Voorheis et al. | |
| 6,992,135 | B2 | 1/2006 | Boehm et al. | |
| 2004/0038753 | A1* | 2/2004 | Kato | A63B 37/0003 473/378 |
| 2011/0312444 | A1* | 12/2011 | Sullivan | A63B 37/0063 473/376 |

OTHER PUBLICATIONS

Dalton, Jeff, "Compression by any Other Name", Science and Golf IV, Proceedings of the World Scientific Congress of Golf (Eric Thain ed., Routledge, 2002).

* cited by examiner

*Primary Examiner* — Raeann Gorden
(74) *Attorney, Agent, or Firm* — Bradley Arant Boult Cummings LLP

(57) ABSTRACT

Multi-layer golf ball cores having positive hardness and compression gradients and golf balls including these cores are disclosed. The hardness, compression, and diameter relationships in the core assemblage components help to reduce the spin rate of the ball off the driver while still providing desirable performance characteristics in and around the green.

20 Claims, 3 Drawing Sheets

GOLF BALLS HAVING REDUCED DRIVER SPIN

FIELD OF THE INVENTION

The present disclosure relates generally to multi-layer golf balls. More particularly, the present disclosure relates to golf balls having a core assemblage that includes multiple components having hardness, compression, and diameter relationships that result in a reduction in driver spin when included in a golf ball.

BACKGROUND OF THE INVENTION

The performance of a golf ball is affected by a variety of factors including the materials, weight, size, dimple pattern, and external shape of the golf ball. Golf ball manufacturers are constantly improving or tweaking the performance of golf balls by adjusting the materials and construction of the ball as well as the dimple pattern and dimple shape.

The spin rate refers to the rate of rotation of the golf ball after being hit with a club. Golf balls with high spin rates generally feature three or four layers and typically include a solid core, one or two intermediate layers, and a relatively soft cover. Two piece golf balls that have a large core and a relatively thin, hard outer layer generally deliver less spin and maximum distance. In other words, more golf ball layers generally (but not always) equates to more spin. Most professionals and highly skilled amateurs (i.e., those who can control the spin of a golf ball) prefer balls with high spin rates to allow for better control in and around the green and draw and fade on approach shots. Indeed, these balls are beneficial for short distance shots made with irons and wedges. In contrast, recreational players who cannot necessarily control the spin of the ball will likely find that it is easier to play with a low spin golf ball because the spin from a golf ball with a high spin rate can create more shot dispersion, i.e., more stray off to the left or right of the centerline, especially if the ball is hooked or sliced.

Accordingly, there remains a need for multi-layer golf balls, i.e., golf balls having more than a core and a cover layer, to have reduced spin off of a driver, while also maintaining the overall performance of the golf ball on short shots. In this aspect, it would be advantageous to identify multi-layer golf balls with less dispersion and more distance for long shots. The present disclosure describes provides core assemblages and golf balls containing the core assemblages that have less spin, less dispersion, and more distance on long shots as compared to conventional multi-layer golf balls.

SUMMARY OF THE INVENTION

The present disclosure relates to a golf ball with a core assemblage including: a center having a surface hardness H1, a diameter D1, and a SCDI compression C1; an inner core layer disposed about the center having a surface hardness H2, a diameter D2, and a SCDI compression C2, wherein H1 is about 60 percent to about 90 percent of H2 and C1 is about 25 percent to about 60 percent of C2; an outer core layer disposed about the inner core layer having a surface hardness H3, a diameter D3, and a SCDI compression C3, wherein H2 is about 60 percent to about 90 percent of H3 and C2 is about 40 percent to about 80 percent of C3; an intermediate layer disposed about the core assemblage to form an intermediate ball; and a cover layer disposed about the intermediate ball.

In some embodiments, the center includes a first rubber formulation including a first amount of zinc diacrylate, the inner core layer includes a second rubber formulation including a second amount of zinc diacrylate, and the outer core layer includes a third rubber formulation including a third amount of zinc diacrylate. In one aspect, the first amount of zinc diacrylate is about 30 to about 70 percent of the second amount of zinc diacrylate. In another aspect, the second amount of zinc diacrylate is about 50 to about 75 percent of the third amount of zinc diacrylate. The first, second, and third rubber formulations may include polybutadiene rubber, butyl rubber, or a blend thereof.

In other embodiments, D1 is about 60 percent to 80 percent of D2 and D2 is about 60 percent to about 80 percent of D3. In still other embodiments, the cover layer having a thickness in the range of about 0.010 to about 0.080 inches. In yet other embodiments, the cover layer includes a material selected from the group consisting of polyurethanes, polyureas, and hybrids, copolymers, and blends thereof. The intermediate layer may include an ionomer material. In still other embodiments, H1 is in the range of about 60 to about 80 Shore C, H2 is in the range of about 70 to about 90 Shore C, and H3 is in the range of about 80 to about 100 Shore C to provide a positive hardness gradient from the center to the outer core layer.

The present disclosure also relates to a golf ball with a core assemblage including: a center having a surface hardness H1, a diameter D1, and a SCDI compression C1; an inner core layer disposed about the center having a surface hardness H2, a diameter D2, and a SCDI compression C2, wherein $$0.2 \leq \frac{\frac{H_1}{H_2}}{\frac{C_2}{C_1}} \leq 0.5;$$

an outer core layer disposed about the inner core layer having a surface hardness H3, a diameter D3, and a SCDI compression C3, wherein $$0.5 \leq \frac{\frac{H_2}{H_3}}{\frac{C_3}{C2_1}} \leq 0.8;$$

an intermediate layer disposed about the core assemblage to form an intermediate ball; and a cover layer disposed about the intermediate ball.

In some embodiments, H1 is in the range of about 60 to about 80 Shore C, H2 is in the range of about 70 to about 90 Shore C, and H3 is in the range of about 80 to about 100 Shore C to provide a positive hardness gradient from the center to the outer core layer. In other embodiments, $$0.15 \leq \frac{\frac{H_1}{H_3}}{\frac{C_3}{C_1}} \leq 0.35;$$

In still other embodiments, the center includes a first rubber formulation including a first amount of co-agent, the inner core layer includes a second rubber formulation including a second amount of co-agent, and the outer core layer includes a third rubber formulation including a third amount of co-agent. In yet other embodiments, the first amount of co-agent is about 30 to about 70 percent of the second amount of co-agent. In still other embodiments, the second amount of co-agent is about 50 to about 75 percent of the third amount of co-agent.

The present disclosure further relates to a golf ball with a core assemblage including: a center having a surface hardness H1, a diameter D1, and a SCDI compression C1; an inner core layer disposed about the center having a surface hardness H2, a diameter D2, and a SCDI compression C2; an outer core layer disposed about the inner core layer having a surface hardness H3, a diameter D3, and a SCDI compression C3, wherein C2 is about 50 percent to about 80 percent of C3, and wherein $$\frac{1}{2}(H_1+H_2)>\frac{1}{3}(H_1+H_3) \text{ and } \frac{1}{2}(H_1+H_2)>\frac{1}{3}(H_2+H_3);$$

an intermediate layer disposed about the core assemblage to form an intermediate ball; and a cover layer disposed about the intermediate ball.

In some embodiments, H1 is in the range of about 60 to about 80 Shore C, H2 is in the range of about 70 to about 90 Shore C, and H3 is in the range of about 80 to about 100 Shore C to provide a positive hardness gradient from the center to the outer core layer. In other embodiments, the cover layer includes a material selected from the group consisting of polyurethanes, polyureas, and hybrids, copolymers, and blends thereof. In still other embodiments, the intermediate layer includes an ionomer material.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
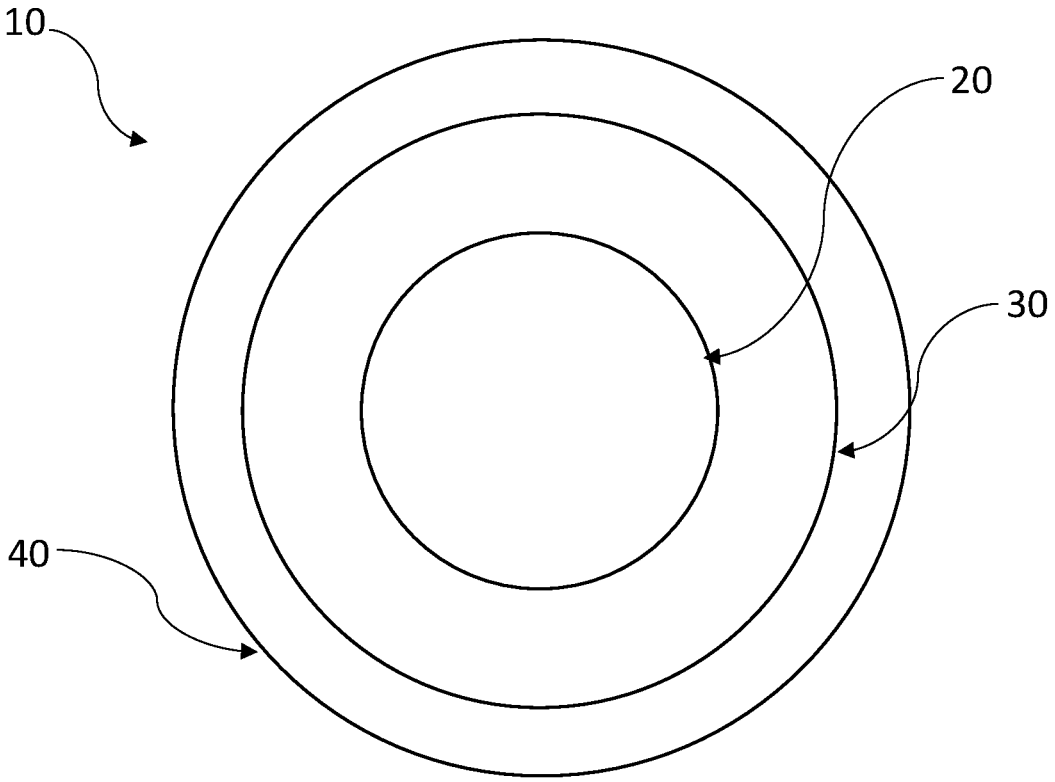
FIG. 1 is a cross-sectional view of a core assemblage in accordance with an embodiment of the present invention.

The golf balls of the present disclosure include a core assemblage with a positive hardness and compression gradient. In addition, the core assemblage is built such that each core component has a diameter that is about 50 to 90 percent of the diameter of the next (outer core component). The novel golf balls achieve a reduction in driver spin when compared to a conventional multi-layer golf ball hit under the same conditions. Advantageously, the combination of a core assemblage with an increasing hardness and compression gradient and a dual cover provides reduced spin on long shots (off the driver) while still delivering desired short game control on approach shots and greenside play.

Without being bound by any particular theory, each core component/layer of the core assemblage is functionally different from the others and operates somewhat independently, but each component influences and responds to the components closest to it in a way that makes the finished golf ball (that contains a core assemblage of the present disclosure) perform differently than its conventional multi-layer counterpart golf ball. The core of a golf ball is the largest part of the ball and, as such, has the biggest effect on long shots, e.g., off of a driver. And, since compression is driven mainly by the core, adjusting compression, even in relatively small amounts, may have a fairly significant effect on long shot performance. In this aspect, since the firmness of the core material and size of the core affects compression of the golf ball, adjusting either or both of these properties have an advantageous effect on speed and spin, especially on long shots.

Core Formulations

Construction

In one embodiment, golf balls made in accordance with the present disclosure have a core assemblage with a center, an inner core layer disposed about the center, and an outer core layer disposed about the inner core layer. Additional layers may also be used in the core assemblage provided that a positive hardness and compression gradient is maintained.

Formulation

Each of the components of the core assemblage may be formed from a rubber formulation. In one embodiment, the rubber formulation includes a base rubber in an amount of about 5 percent to 100 percent by weight based on total weight of formulation. In one embodiment, the base rubber is included in the rubber formulation in an amount within a range having a lower limit of 5 percent or 10 percent or 20 percent or 30 percent or 40 percent or 50 percent and an upper limit of 55 percent or 60 percent or 70 percent or 80 percent or 90 percent or 95 percent or 100 percent. For example, the base rubber may be present in the rubber formulation in an amount of about 40 percent to about 95 percent by weight based on the total weight of the formulation.

The base rubber may be polybutadiene, polyisoprene, ethylene propylene rubber, ethylene-propylene-diene rubber, styrene-butadiene rubber, styrenic block copolymer rubbers, polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and blends of two or more thereof. In another embodiment, the rubber formulation includes polybutadiene rubber, butyl rubber, or a blend thereof as the base rubber.

For example, the rubber formulation may include polybutadiene. Polybutadiene is a homopolymer of 1,3-butadiene. The double bonds in the 1,3-butadiene monomer are attacked by catalysts to grow the polymer chain and form a polybutadiene polymer having a desired molecular weight. Any suitable catalyst may be used to synthesize the polybutadiene rubber depending upon the desired properties. In one embodiment, a transition metal complex (for example, neodymium, nickel, or cobalt) or an alkyl metal such as alkyl lithium is used as a catalyst. Other catalysts include, but are not limited to, aluminum, boron, lithium, titanium, and combinations thereof. The catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber can have various combinations of cis- and trans-bond structures. For example, the polybutadiene rubber may have a 1,4 cis-bond content of at least 40%. In another embodiment, the polybutadiene rubber has a 1,4 cis-bond content of greater than 80%. In still another embodiment, the polybutadiene rubber has a 1,4 cis-bond content of greater than 90%. In general, polybutadiene rubbers having a high 1,4 cis-bond content have high tensile strength.

The polybutadiene rubber may have a relatively high or low Mooney viscosity. Generally, polybutadiene rubbers of higher molecular weight and higher Mooney viscosity have better resiliency than polybutadiene rubbers of lower molecular weight and lower Mooney viscosity. However, as the Mooney viscosity increases, the milling and processing of the polybutadiene rubber generally becomes more difficult. Blends of high and low Mooney viscosity polybutadiene rubbers may be prepared as is described in U.S. Pat. Nos. 6,982,301 and 6,774,187, the disclosures of which are hereby incorporated by reference, and used in accordance with this invention. In general, the lower limit of Mooney viscosity may be 30 or 35 or 40 or 45 or 50 or 55 or 60 or 70 or 75 and the upper limit may be 80 or 85 or 90 or 95 or 100 or 105 or 110 or 115 or 120 or 125 or 130.

Examples of commercially available polybutadiene rubbers that can be used in rubber formulations in accordance with this invention, include, but are not limited to, BR 01 and BR 1220, available from BST Elastomers of Bangkok, Thailand; SE BR 1220LA and SE BR1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 MES, CB 60, CB Nd 60, CB 55 NF, CB 70 B, CB KA 8967, and CB 1221, available from Lanxess Corp. of Pittsburgh. Pa.; BR1208, available from LG Chemical of Seoul, South Korea; UBEPOL BR130B, BR150, BR150B, BR150L, BR230, BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; AFDENE 50 and NEODENE BR40, BR45, BR50 and BR60, available from Karbochem (PTY) Ltd. of Bruma, South Africa; KBR 01, NdBr 40, NdBR-45, NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio; and PBR-Nd Group II and Group III, available from Nizhnekamskneftekhim, Inc. of Nizhnekamsk, Tartarstan Republic.

In another embodiment, the components of the core assemblage are formed from a rubber formulation including butyl rubber. Butyl rubber is an elastomeric copolymer of isobutylene and isoprene. Butyl rubber is an amorphous, non-polar polymer with good oxidative and thermal stability, good permanent flexibility and high moisture and gas resistance. Generally, butyl rubber includes copolymers of about 70 percent to about 99.5 percent by weight of an isoolefin, which has about 4 to 7 carbon atoms, for example, isobutylene, and about 0.5 percent to about 30 percent by weight of a conjugated multiolefin, which has about 4 to 14 carbon atoms, for example, isoprene. The resulting copolymer contains about 85 percent to about 99.8 percent by weight of combined isoolefin and about 0.2 percent to about 15 percent of combined multiolefin. A commercially available butyl rubber includes Bayer Butyl 301 manufactured by Bayer AG.

In still another embodiment, the rubber formulations used to form the components of the core assemblage include a blend of polybutadiene and butyl rubber. In this embodiment, the rubber formulation may include a blend of polybutadiene and butyl rubber in a ratio of about 10:90 to about 90:10. For example, the core layer may include a blend of polybutadiene and butyl rubber in a ratio of about 30:70 to about 70:30 or about 40:60 to about 60:40. In other embodiments, the rubber formulation may include polybutadiene and/or butyl rubber in a blend with any of the other elastomers discussed above.

The rubber formulations further include a reactive cross-linking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. In one embodiment, the co-agent is one or more metal salts of acrylates, diacrylates, methacrylates, and dimethacrylates, wherein the metal is selected from magnesium, calcium, zinc, aluminum, lithium, and nickel. In another embodiment, the co-agent includes one or more zinc salts of acrylates, diacrylates, methacrylates, and dimethacrylates. For example, the co-agent may be zinc diacrylate (ZDA).

The co-agent may be included in the rubber formulation in varying amounts depending on the specific core component for which the rubber formulation is intended. In one embodiment, the amount of co-agent used in the rubber formulations increases for each outer component of the core assemblage. In other words, the co-agent in the rubber formulation for the center is included in a first amount, the co-agent in the rubber formulation for the inner core layer is included in a second amount, and the co-agent in the rubber formulation for the outer core layer is included in a third amount. The third amount may be more than the second amount and the second amount may be more than the first amount. In this aspect, the first amount may be about 25 percent to about 50 percent of the third amount. For example, the first amount may be about 30 percent to about 45 percent of the third amount. In this same aspect, the first amount may be about 20 percent to about 67 percent of the second amount. For example, the first amount may be about 33 percent to about 65 percent of the second amount or 45 percent to about 60 percent of the second amount. Similarly, the second amount may be about 50 percent to about 75 percent of the third amount. For example, the second amount may be about 60 percent to about 75 percent of the third amount.

For example, when the rubber formulation is intended for use in the center, the co-agent may be used in an amount of about 1 to about 20 parts by weight per 100 parts of the total rubber. In one embodiment, the rubber formulation for the center of the core assemblage includes about 5 to about 20 parts by weight co-agent per 100 parts of the total rubber. In another embodiment, the co-agent is included in the rubber formulation for the center in an amount of about 10 to about 20 parts by weight per 100 parts of the total rubber. In still another embodiment, the rubber formulation for the center of the core assemblage includes about 15 to about 20 parts by weight co-agent per 100 parts of the total rubber.

The inner core layer may be formed from a rubber formulation that includes about 21 parts to about 30 parts by weight co-agent per 100 parts of the total rubber. In one embodiment, the co-agent is included in the rubber formulation for the inner core layer in an amount of about 23 parts to about 28 parts by weight co-agent per 100 parts of the total rubber. For example, the rubber formulation for the inner core layer may include about 24 parts to about 27 parts by weight co-agent per 100 parts of the total rubber.

The rubber formulation for the outer core layer may include about 31 parts to about 40 parts by weight co-agent per 100 parts of the total rubber. In one embodiment, the co-agent is included in the rubber formulation for the outer core layer in an amount of about 33 parts to about 38 parts by weight per 100 parts of the total rubber. For example, the rubber formulation for the outer core layer may include about 34 parts to about 37 parts by weight co-agent per 100 parts of the total rubber.

Moreover, the co-agent in each rubber formulation may be the same or different. In particular, the co-agent used in the rubber formulation for the center may be different or the same as the co-agent used in the rubber formulation for the inner core layer. Similarly, the rubber formulation for the outer core layer may be the same or different than the co-agent used in the rubber formulation for the center and/or inner core layer.

In some embodiments, the co-agent used in each of the rubber formulations for the center, inner core layer, and outer core layer of the core assemblage is zinc diacrylate. In this aspect, the zinc diacrylate may be used in an amount of about 11 to about 20 parts by weight per 100 parts of the total rubber for the center rubber formulation, an amount of about 21 to about 30 parts by weight per 100 parts of the total rubber in the inner core layer rubber formulation, and an amount of about 31 to about 40 parts by weight per 100 parts of the total rubber in the outer core layer rubber formulation. In another embodiment, the zinc diacrylate may be used in an amount of about 15 to about 20 parts by weight per 100 parts of the total rubber for the center rubber formulation, an amount of about 25 to about 30 parts by weight per 100 parts of the total rubber in the inner core layer rubber formulation, and an amount of about 35 to about 40 parts by weight per 100 parts of the total rubber in the outer core layer rubber formulation.

Radical scavengers such as a halogenated organosulfur, organic disulfide, or inorganic disulfide compounds may also be added to the rubber formulation. In one embodiment, a halogenated organosulfur compound included in the rubber formulation includes, but is not limited to, pentachlorothiophenol (PCTP) and salts of PCTP such as zinc pentachlorothiophenol (ZnPCTP). In another embodiment, ditolyl disulfide, diphenyl disulfide, dixylyl disulfide, 2-nitroresorcinol, and combinations thereof are added to the rubber formulation.

The rubber formulation may also include filler(s). Suitable non-limiting examples of fillers include carbon black, clay and nanoclay particles, talc, glass (e.g., glass flake, milled glass, and microglass), mica and mica-based pigments (e.g., Iriodin® pearl luster pigments from The Merck Group), and combinations thereof. Metal fillers are also contemplated for inclusion in the rubber formulation such as, for example, particulate, powders, flakes, and fibers of copper, steel, brass, tungsten, titanium, aluminum, magnesium, molybdenum, cobalt, nickel, iron, lead, tin, zinc, barium, bismuth, bronze, silver, gold, and platinum, and alloys and combinations thereof. The concentration of the fillers when included may be in an amount of about 1 percent to about 20 percent by weight based on total weight of rubber formulation. In one embodiment, the rubber formulation includes at least one filler in an amount of about 5 percent to about 15 percent by weight of the total weight of the rubber formulation.

Antioxidants, processing aids, accelerators (for example, tetra methylthiuram), dyes and pigments, wetting agents, surfactants, plasticizers, coloring agents, fluorescent agents, chemical blowing and foaming agents, defoaming agents, stabilizers, softening agents, impact modifiers, antiozonants, as well as other additives known in the art, may also be added to the rubber formulation. Examples of suitable processing aids include, but are not limited to, high molecular weight organic acids and salts thereof. Suitable organic acids are aliphatic organic acids, aromatic organic acids, saturated mono-functional organic acids, unsaturated mono-functional organic acids, multi-unsaturated mono-functional organic acids, and dimerized derivatives thereof. In one embodiment, the organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, and dimerized derivatives thereof. The salts of organic acids include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof.

The rubber formulation may be cured using conventional curing processes. Non-limiting examples of curing processes suitable for use in accordance with the present invention include peroxide-curing, sulfur-curing, high-energy radiation, and combinations thereof. In one embodiment, the rubber formulation includes a free-radical initiator selected from organic peroxides, high energy radiation sources capable of generating free-radicals, and combinations thereof. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BC, commercially available from Akzo Nobel. Peroxide free-radical initiators may be present in the rubber formulation in an amount of at least 0.05 parts by weight per 100 parts of the total rubber, or an amount within the range having a lower limit of 0.05 parts or 0.1 parts or 1 part or 1.25 parts or 1.5 parts or 2.5 parts or 5 parts by weight per 100 parts of the total rubbers, and an upper limit of 2.5 parts or 3 parts or 5 parts or 6 parts or 10 parts or 15 parts by weight per 100 parts of the total rubber. Concentrations are in parts per hundred (phr) unless otherwise indicated. As used herein, the term, "parts per hundred," also known as "phr" or "pph" is defined as the number of parts by weight of a particular component present in a mixture, relative to 100 parts by weight of the polymer component. Mathematically, this can be expressed as the weight of an ingredient divided by the total weight of the polymer, multiplied by a factor of 100.

Properties

Hardness

The hardness of the geometric center of the center (or center of the core assemblage) may be obtained according to the following: the center (or core assemblage) is first gently pressed into a hemispherical holder having an internal diameter approximately slightly smaller than the diameter of the center (or core assemblage), such that the center is held in place in the hemispherical portion of the holder while concurrently leaving the geometric central plane of the center exposed. The center is secured in the holder by friction, such that it will not move during the cutting and grinding steps, but the friction is not so excessive that distortion of the natural shape of the core would result. The center is secured such that the parting line of the center is roughly parallel to the top of the holder. The diameter of the center is measured 90 degrees to this orientation prior to securing. A measurement is also made from the bottom of the holder to the top of the center to provide a reference point for future calculations. A rough cut is made slightly above the exposed geometric center of the core using a band saw or other appropriate cutting tool, making sure that the center does not move in the holder during this step. The remainder of the center, still in the holder, is secured to the base plate of a surface grinding machine. The exposed 'rough' surface is ground to a smooth, flat surface, revealing the geometric center of the center, which can be verified by measuring the height from the bottom of the holder to the exposed surface of the center, making sure that exactly half of the original height of the center, as measured above, has been removed to within 0.004 inches. Leaving the center in the holder, the geometric center of the center is confirmed with a center square and carefully marked and the hardness is measured at the center mark according to ASTM D-2240.

Additional hardness measurements at any distance from the geometric center of the center can then be made by drawing a line radially outward from the geometric center mark, and measuring the hardness at any given distance along the line, typically in 2 mm increments from the center. The hardness at a particular distance from the geometric center should be measured along at least two, preferably four, radial arms located 180° apart, or 90° apart, respectively, and then averaged. All hardness measurements performed on a plane passing through the geometric center are performed while the center is still in the holder and without having disturbed its orientation, such that the test surface is constantly parallel to the bottom of the holder, and thus also parallel to the properly aligned foot of the durometer.

The outer surface hardness of a core layer (or any golf ball layer) is measured on the actual outer surface of the layer and is obtained from the average of a number of measurements taken from opposing hemispheres, taking care to avoid making measurements on the parting line of the core or on surface defects, such as holes or protrusions and preferably making the measurements prior to surrounding the layer of interest with an additional layer. Hardness measurements are made pursuant to ASTM D-2240 "Indentation Hardness of Rubber and Plastic by Means of a Durometer." Because of the curved surface, care must be taken to ensure that the golf ball or golf ball sub-assembly is centered under the durometer indenter before a surface hardness reading is obtained. A calibrated, digital durometer, capable of reading to 0.1 hardness units is used for the hardness measurements. The digital durometer must be attached to, and its foot made parallel to, the base of an automatic stand. The weight on the durometer and attack rate conforms to ASTM D-2240. It is worthwhile to note that, once an additional layer surrounds a layer of interest, the hardness of the layer of interest can be difficult to determine. Therefore, for purposes of the present invention, when the hardness of a layer is needed after the inner layer has been surrounded with another layer, the test procedure for measuring a point located 1 mm from an interface is used.

It should also be noted that there is a fundamental difference between "material hardness" and "hardness as measured directly on a golf ball" (or, as used herein, "surface hardness"). For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of layers, and the like); ball (or ball sub-assembly) diameter; and the material composition of adjacent layers. It also should be understood that the two measurement techniques are not linearly related and, therefore, one hardness value cannot easily be correlated to the other. Shore hardness (for example, Shore C or Shore D hardness) was measured according to the test method ASTM D-2240.

The center has a geometric center hardness that ranges from about 40 to about 60 Shore C. In one embodiment, the hardness at the geometric center is about 45 to about 55 Shore C. For example, the center may have a hardness at its geometric center of about 48 to about 52 Shore C. The hardness at the surface of the center may range from about 60 to about 80 Shore C. In one embodiment, the hardness at the surface of the center is about 65 to about 75 Shore C. For example, the center may have a surface hardness of about 68 to about 72 Shore C.

The inner core layer has a hardness at the surface that may range from about 70 to about 90 Shore C. In one embodiment, the surface hardness of the inner core layer is about 75 to about 85 Shore C. For example, the surface hardness of the inner core layer may have a hardness of about 78 to about 82 Shore C.

The outer core layer has a hardness at the surface that may range from about 80 to about 100 Shore C. In one embodiment, the surface hardness of the outer core layer is about 85 to about 95 Shore C. For example, the surface hardness of the outer core layer may have a hardness of about 88 to about 92 Shore C.

In some embodiments, the hardness at the surface of the center may be about 60 percent to about 95 percent of the hardness at the surface of the inner core. In one embodiment, the surface of the center has a hardness of about 65 percent to about 90 percent of the hardness at the surface of the inner core. In another embodiment, the center has a surface hardness that is about 70 percent to about 90 percent of the hardness at the surface of the inner core. Similarly, the hardness at the surface of the inner core may be about 70 percent to about 95 percent of the hardness at the surface of the core assemblage. In one embodiment, the surface of the inner core has a hardness of about 75 percent to about 92 percent of the hardness at the surface of the core assemblage. In another embodiment, the inner core has a surface hardness that is about 78 percent to about 90 percent of the hardness at the surface of the core assemblage.

The direction of the hardness gradient is defined by the difference in hardness measurements taken at the geometric center and outer surfaces of the center and inner and outer core layers. The geometric center hardness is readily determined according to the test procedures provided above. For example, the outer surface of the center (or inner core or outer core layers) is also readily determined according to the procedures given herein for measuring the outer surface hardness of a golf ball layer, if the measurement is made prior to surrounding the layer with an additional core layer.

While the gradient across the core assemblage will vary based on several factors including, but not limited to, the dimensions and formulations of the components, the core assemblage of the present disclosure has a "positive" hardness gradient (that is, the geometric center is softer than the surface of the outer core layer). More particularly, the term, "positive hardness gradient" as used herein means a hardness gradient of positive about 3 Shore C or greater, about 5 Shore C or greater, about 7 Shore C or greater, or about 10 Shore C or greater. In general, the hardness gradient may be determined by subtracting the hardness value of the first component being measured (for example, the outer surface of the center) from the hardness value of the second component being measured (for example, the outer surface of the inner or outer core layers).

In some embodiments, the surface hardness of the center is less than the surface hardness of the inner core layer and the surface hardness of the outer core layer is greater than the surface hardness of the inner core layer. In one embodiment, the positive hardness gradient from the surface of the center to the surface of the inner core layer is in the range of about 5 to about 30 Shore C units. For example, the hardness gradient of the surface of the center to the surface of the inner core layer may be about +10 to about +25 Shore C. Similarly, the positive hardness gradient from the surface of the inner core layer to the surface of the outer core layer is in the range of about 5 to about 30 Shore C units. In one embodiment, the hardness gradient of the surface of the center to the surface of the inner core layer may be about +10 to +25 Shore C. In some embodiments, the positive hardness gradient of the center to the inner core layer is about 10 to 15 Shore C and the positive hardness gradient of the inner core layer to the outer core layer is also about 10 to 15 Shore C.

In another embodiment, the positive hardness gradient from the surface of the center to the surface of the core assemblage (i.e., the surface of the outer core layer) ranges from about 5 to 45 Shore C. In this aspect, the hardness gradient from the surface of the center to the surface of the core assemblage may range from about +10 to about +40 Shore C. For example, the positive gradient from the center surface to the core assemblage surface may be about 15 to about 30 Shore C. In still another embodiment, the positive hardness gradient from the geometric center of the center to the surface of the core assemblage (i.e., the surface of the outer core layer) ranges from about 20 to 60 Shore C. In this aspect, the hardness gradient from the geometric center to the surface of the core assemblage may range from about +30 to about +50 Shore C. For example, the positive gradient from the geometric center to the core assemblage surface may be about 35 to about 45 Shore C.

In some embodiments, a point or plurality of points measured along a "positive" gradients may be above or below a line fit through the gradient and its outermost and innermost hardness values. In an alternative embodiment, the hardest point along a particular steep "positive" gradient may be higher than the value at the innermost portion of the center (the geometric center) or outer core layer—as long as the outermost point (i.e., the outer surface of the center) is greater than the innermost point (i.e., the geometric center of the center), such that the "positive" gradients remain intact.

The center may have a positive hardness gradient from the geometric center to the surface of the center. In one embodiment, the center has a positive hardness gradient of about 5 to 40 Shore C. In this aspect, the positive hardness gradient of the center (from the geometric center to the surface of the center) is about 10 to about 30 Shore C. For example, the positive hardness gradient of the center is about 15 to about 25 Shore C. The center may also have a "zero" hardness gradient, i.e., the hardness values of the outer surface of the outer core layer and the geometric center are substantially the same. The term, "zero hardness gradient" as used herein means a hardness gradient of less than about 3 Shore C, preferably less than about 1 Shore C and may have a value of zero.

In other embodiments, either of the inner or outer core layers may have a "zero" hardness gradient within the layer itself (i.e., the hardness values of the inner surface and outer surface of the inner core layer are substantially the same). In still other embodiments, the outer surface of the inner core layer and the inner surface of the outer core layer may have a substantially similar hardness or the same hardness, but the outer surface of the inner core layer and the outer surface of the outer core layer still have hardness values that differ such that a positive hardness gradient as described above is achieved.

Compression

Several different methods can be used to measure compression, including Atti compression, Riehle compression, load/deflection measurements at a variety of fixed loads and offsets, and effective modulus (see, e.g., Compression by Any Other Name, Science and Golf IV, Proceedings of the World Scientific Congress of Golf (Eric Thain ed., Routledge, 2002) (J. Dalton). For purposes of the present invention, compression values are provided as measured by the Dynamic Compression Machine ("DCM") as well as the Soft Center Deflection Index ("SCDI"). The DCM applies a load to a ball component or a ball and measures the number of inches the core or ball is deflected at measured loads. A crude load/deflection curve is generated that is fit to the Atti compression scale that results in a number being generated that represents an Atti compression. The DCM does this via a load cell attached to the bottom of a hydraulic cylinder that is triggered pneumatically at a fixed rate (typically about 1.0 ft/s) towards a stationary core. Attached to the cylinder is an LVDT that measures the distance the cylinder travels during the testing timeframe. A software-based logarithmic algorithm ensures that measurements are not taken until at least five successive increases in load are detected during the initial phase of the test.

The SCDI is a slight variation of the DCM set up that allows determination of the pounds required to deflect a component or ball 10 percent of its diameter. With the SCDI, the goal is to obtain the pounds of force required to deflect a component or ball a certain amount of inches. That amount of deflection is 10 percent of the component or ball diameter. The DCM is triggered, the cylinder deflects the component or ball by 10 percent of its diameter, and the DCM reports back the pounds of force required (as measured from the attached load cell) to deflect the component or ball by that amount. The SCDI value obtained is a single number in units of pounds.

In some embodiments, the center has a compression of less than 0 DCM or less than about 80 SCDI. For example, the center compression may be less than about 70 SCDI. In one embodiment, the center compression may range from about 70 SCDI to about 79 SCDI.

The inner core (i.e., the center with an inner core layer disposed thereon) may have a compression that ranges from about 40 to about 60 DCM. In one embodiment, the inner core has a compression of about 45 to about 55 DCM. In another embodiment, the inner core has a compression of about 48 to about 52 DCM. Similarly, the inner core compression may range from about 120 to about 160 SCDI. In one embodiment, the inner core has a compression of about 130 SCDI to about 150 SCDI. In another embodiment, the compression of the inner core is about 135 to about 145 SCDI.

The core assemblage (i.e., the inner core with an outer core layer disposed thereon) may have a compression that ranges from about 65 to about 105 DCM. In one embodiment, the core assemblage has a compression of about 75 to about 95 DCM. In another embodiment, the core assemblage has a compression of about 80 to about 90 DCM. Similarly, the core assemblage compression may range from about 200 to about 240 SCDI. In on embodiment, the core assemblage has a compression of about 210 SCDI to about 230 SCDI. In another embodiment, the compression of the core assemblage is about 215 to about 225 SCDI.

In some embodiments, the compression of the center may be about 25 percent to about 80 percent of the compression of the inner core and the compression of the inner core may be about 25 percent to about 80 percent of the core assemblage. For example, the compression of the center may be about 25 percent to about 50 percent of the inner core compression and the compression of the inner core may be about 25 percent to about 75 percent of the core assemblage compression. In another example, the compression of the center may be about 30 percent to about 60 percent of the inner core and the compression of the inner core may be about 50 percent to about 80 percent of the compression of the core assemblage. In still another example, the compression of the center may be less than 1 percent to about 25 percent of the inner core compression and the compression of the inner core may be about 30 percent to about 60 percent of the compression of the core assemblage.

The direction of the compression gradient is defined by the difference in compression measurements of the center, inner core, and core assemblage. While the gradient across the core assemblage (and from component to component) will vary based on several factors including, but not limited to, the dimensions and formulations of the components, the core assemblage of the present disclosure has a "positive" compression gradient (that is, the center has a lower compression than the other core components in the core assemblage and the core assemblage has a higher compression than any of the other core components in the core assemblage). More particularly, the term, "positive compression gradient" as used herein means a compression gradient of positive about 5 (DCM) or greater, about 10 (DCM) or greater, about 20 (DCM) or greater, or about 30 (DCM) or greater or about 10 (SCDI) or greater, about 20 (SCDI) or greater, about 30 (SCDI) or greater, or about 40 (SCDI) or greater. In general, the compression gradient may be determined by subtracting the compression of the first component being measured (for example, the center) from the compression of the second component being measured (for example, the inner core or core assemblage).

In some embodiments, the compression of the center is less than the compression of the inner core and the compression of the core assemblage is greater than the compression of the inner core. In one embodiment, the positive compression gradient from the center to the inner core is in the range of about 30 to 70 (DCM) and/or 40 to 100 (SCDI). For example, the compression gradient of the center to the inner core may be about +40 to about +60 (DCM) and/or about +50 to about +90 (SCDI). In another embodiment, the compression gradient of the center to the inner core may be about +45 to about +55 (DCM) and/or about +60 to about +80 (SCDI).

The positive compression gradient from the inner core to the core assemblage is in the range of about 20 to 75 (DCM) and/or 40 to 120 (SCDI). For example, the compression gradient of the inner core to core assemblage may be about +25 to about +60 (DCM) and/or about +50 to about +110 (SCDI). In another embodiment, the compression gradient of the inner core to core assemblage be about +30 to about +45 (DCM) and/or about +70 to about +90 (SCDI).

The positive compression gradient from the center to the core assemblage is in the range of about 65 to 105 (DCM) and/or 120 to 200 (SCDI). For example, the compression gradient of the core to core assemblage may be about +75 to about +95 (DCM) and/or about +130 to about +180 (SCDI). In another embodiment, the compression gradient of the center to the core assemblage may be about +80 to about +90 (DCM) and/or about +140 to about +160 (SCDI).

The center itself also has a positive compression gradient of about 1 to about 10 (DCM) and/or about 10 to about 70 (SCDI). In some embodiments, the compression gradient of the center is about 1 to about 5 (DCM). In other embodiments, the center has a compression gradient of about 10 to about 40 (SCDI). In still other embodiments, the compression gradient of the center is about 5 to about 10 (DCM). In yet other embodiments, the center has a compression gradient of about 40 to about 70 (SCDI).

Diameter

The diameter of the components of the core assemblage may vary, but the core assemblage diameter is larger than the diameter of the inner core and the diameter of the center is less than the diameter of the inner core. In one embodiment, the diameter of the center is between about 50 percent and 90 percent of the diameter of the inner core. For example, the center diameter may range from about 55 percent and 85 percent of the diameter of the inner core. In another embodiment, the diameter of the center is between about 60 percent and 80 percent of the diameter of the inner core.

Likewise, the diameter of the inner core may be about 50 percent and 90 percent of the diameter of the core assemblage. For example, the inner core diameter may range from about 55 percent and 85 percent of the diameter of the core assemblage. In another embodiment, the diameter of the inner core is between about 60 percent and 80 percent of the diameter of the core assemblage.

The diameter of the center may be about 45 percent and 70 percent of the diameter of the core assemblage. For example, the center diameter may range from about 47 percent and 68 percent of the diameter of the core assemblage. In another embodiment, the diameter of the center is between about 48 percent and 65 percent of the diameter of the core assemblage.

In some embodiments, the center diameter may range from about 0.75 inches to about 1.0 inches. For example, the center diameter may range from about 0.75 to about 0.85 inches. In another embodiment, the center diameter may range from about 0.85 inches to about 1.0 inch. The inner core diameter may range from about 1.13 to about 1.30 inch. In one embodiment, the inner core diameter mar range from about 1.20 inch to about 1.30 inch. In another embodiment, the inner core diameter may range from about 1.22 inch to about 1.28 inch. The core assemblage diameter may range from about 1.50 inch to about 1.60 inch. In one embodiment, the core assemblage has a diameter of about 1.52 inch to about 1.58 inch. In another embodiment, the core assemblage diameter ranges from about 1.54 inch to about 1.56 inch.

Core Component Relationships

In one embodiment, the amount of coagent present in the rubber formulation used to form the center is related to the compression gradient (SCDI) of the core assemblage, i.e., the inner core with an outer core layer disposed thereon, according to the relationship shown in Equation I below:

$$\frac{CA_C}{1-\frac{1}{CGr_{SCDI}}} \leq 0.2 \quad \text{(I)}$$

where $CA_C$ represents the weight percent of co-agent in the rubber formulation, in decimal form, based on 100 parts of base rubber in the center rubber formulation, and $CA_C \leq 0.2$; and $CGr_{SCDI}$ represents the compression gradient (SCDI) of the core assemblage. In another embodiment, $$0.1 \leq \frac{CA_C}{1-\frac{1}{CGr_{SCDI}}} \leq 0.2$$

In one embodiment, the amount of coagent present in the rubber formulation used to form the center is related to the compression gradient (DCM) of the core assemblage, i.e., the inner core with an outer core layer disposed thereon, according to the relationship shown in Equation II below:

$$\frac{CA_C}{1-\frac{1}{CGr_{DCM}}} \leq 0.2 \quad \text{(II)}$$

where $CA_C$ represents the weight percent of co-agent in the rubber formulation, in decimal form, based on 100 parts of base rubber in the center rubber formulation, and $0 \leq CA_C \leq 0.2$; and $CGr_{DCM}$ represents the compression gradient (DCM) of the core assemblage. In another embodiment, $$0.1 \leq \frac{CA_C}{1-\frac{1}{CGr_{DCM}}} \leq 0.2$$

In another embodiment, the amount of coagent present in the rubber formulation used to form inner core layer is related to the compression gradient of the core assemblage according to the relationship shown in Equation III below:

$$\frac{CA_{IC}}{1-\frac{1}{CGr_{SCDI}}} \leq 0.3 \quad \text{(III)}$$

where $CA_{IC}$ represents the weight percent of co-agent in the rubber formulation, in decimal form, based on 100 parts of base rubber in the inner core layer rubber formulation, and $CA_{IC} \leq 0.3$. In another embodiment, $$0.20 < \frac{CA_{IC}}{1-\frac{1}{CGr_{SCDI}}} \leq 0.3$$

In still another embodiment, the amount of coagent present in the rubber formulation used to form the inner core layer is related to the compression gradient (DCM) of the core assemblage according to the relationship shown in Equation IV below:

$$\frac{CA_{IC}}{1-\frac{1}{CGr_{DCM}}} \leq 0.3 \quad \text{(IV)}$$

where $CA_{IC}$ represents the weight percent of co-agent in the rubber formulation, in decimal form, based on 100 parts of base rubber in the inner core layer rubber formulation, and $CA_C \leq 0.3$; and $CGr_{DCM}$ represents the compression gradient (DCM) of the core assemblage. In another embodiment, $$0.20 < \frac{CA_{IC}}{1-\frac{1}{CGr_{DCM}}} \leq 0.3$$

The core assemblage also has one or more the following hardness and compression relationships between the components:

a)

$$0.2 \leq \frac{\frac{H_1}{H_2}}{\frac{C_2}{C_1}} \leq 0.5 \quad \text{(V)}$$

where $H_1$ represents the surface hardness (Shore C) of the center, $H_2$ represents the surface hardness of the inner core, $C_2$ represents the SCDI compression of the inner core, and $C_1$ represents the SCDI compression of the center;

b)

$$0.5 \leq \frac{\frac{H_2}{H_3}}{\frac{C_3}{C_2}} \leq 0.8 \quad \text{(VI)}$$

where $H_2$ represents the surface hardness (Shore C) of the inner core layer, $H_3$ represents the surface hardness of the core assemblage (outer core layer), $C_2$ represents the SCDI compression of the inner core, and $C_3$ represents the SCDI compression of the core assemblage;

c)

$$0.15 \leq \frac{\frac{H_1}{H_3}}{\frac{C_3}{C_1}} \leq 0.35 \quad \text{(VII)}$$

where $H_1$ represents the surface hardness (Shore C) of the center, $H_3$ represents the surface hardness of the core assemblage (outer core layer), $C_3$ represents the SCDI compression of the core assemblage and $C_1$ represents the SCDI compression of the center;

d) half of the sum of the hardness values at the surfaces of the center and inner core ($H_1$+$H_2$) is greater than one third of the sum of the hardness values at the surfaces of the center and the core assemblage ($H_1$+$H_3$):

$$\frac{1}{2}(H_1 + H_2) > \frac{1}{3}(H_1 + H_3); \quad \text{(VIII)}$$

and e) half of the sum of the hardness values at the surfaces of the center and inner core ($H_1$+$H_2$) is greater than one third of the sum of the hardness values at the surfaces of the inner core and the core assemblage ($H_2$+$H_3$):

$$\frac{1}{2}(H_1 + H_2) > \frac{1}{3}(H_2 + H_3). \quad \text{(IX)}$$

Golf Ball Construction

Figure 2:
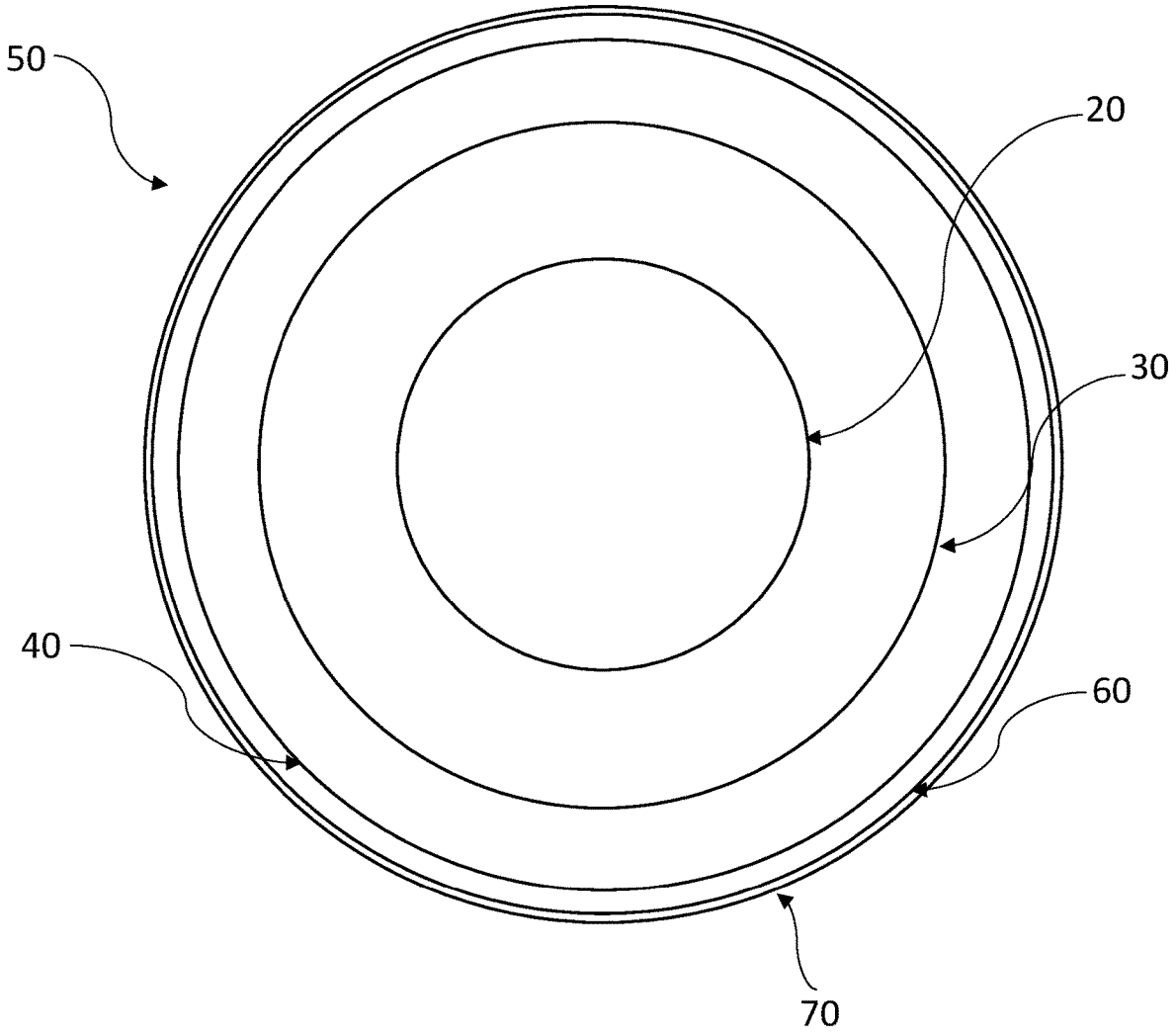
FIG. 2 is a cross-sectional view of a five-piece golf ball in accordance with an embodiment of the present invention.
Figure 3:
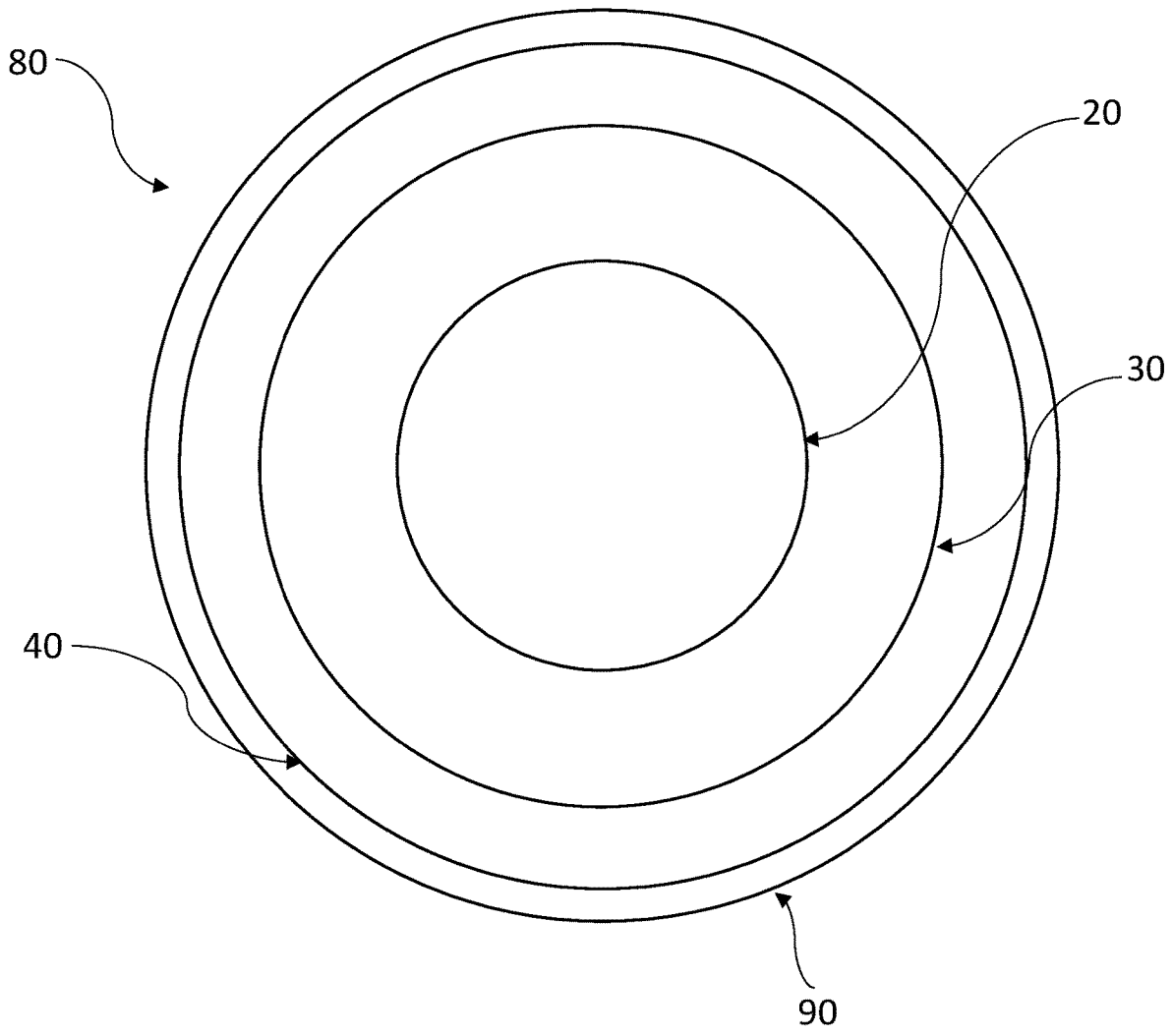
FIG. 3 is a cross-sectional view of a four-piece golf ball in accordance with an embodiment of the present invention.

As discussed above, a core assemblage 10 including a center 20, an inner core layer 30, and outer core layer 40 is formed in accordance with this invention. The core assemblage is used to manufacture a finished golf ball. For example, referring to FIG. 2, in one version, a five-piece golf ball 50 can be made in accordance with this invention. The ball 50 contains the core assemblage 10 from FIG. 1 encased by a multi-layered cover comprising a layer 60 disposed between the core assemblage and an outer cover 70. The layer 60 may be considered an intermediate layer, casing or mantle layer, or inner cover layer, or any other layer disposed between the core assemblage and the outer cover of the ball. Referring to FIG. 3, in another version, a four-piece golf ball 80 contains the core assemblage 10 from FIG. 1 surrounded by a single-layer cover 90.

Golf balls made in accordance with this invention can be of any size, although the USGA requires that golf balls used in competition have a diameter of at least 1.68 inches. For play outside of United States Golf Association (USGA) rules, the golf balls can be of a smaller size. In one embodiment, golf balls made in accordance with this invention have a diameter in the range of about 1.68 to about 1.80 inches.

In contrast to the core, the cover of a golf ball plays less of a role on shots off of a driver. However, because the cover plays a large role in generating spin on iron and wedge shots, the cover material and properties are still important. In this aspect, different materials may be used in the construction of the intermediate and cover layers of golf balls according to the present disclosure. For example, a variety of materials may be used for forming the outer cover including, for example, polyurethanes; polyureas; copolymers, blends and hybrids of polyurethane and polyurea; olefin-based copolymer ionomer resins; polyethylene, including, for example, low density polyethylene, linear low density polyethylene, and high density polyethylene; polypropylene; rubber-toughened olefin polymers; acid copolymers, for example, poly(meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer and; cross-linked trans-polyisoprene and blends thereof; polyester-based thermoplastic elastomers; polyurethane-based thermoplastic elastomers; synthetic or natural vulcanized rubber; and combinations thereof.

In one embodiment, the outer cover is formed from a polyurethane, polyurea, or hybrid of polyurethane-polyurea. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Conventional and non-conventional materials may be used for forming intermediate layers of the ball including, for instance, ionomer resins, highly neutralized polymers, polybutadiene, butyl rubber, and other rubber-based core formulations, and the like. In one embodiment, the inner core layer, i.e., the layer disposed between the core assemblage and the outer cover, includes an ionomer. In this aspect, ionomers suitable for use in accordance with the present disclosure may include partially-neutralized ionomers and highly-neutralized ionomers (HNPs), including ionomers formed from blends of two or more partially-neutralized ionomers, blends of two or more highly-neutralized ionomers, and blends of one or more partially-neutralized ionomers with one or more highly-neutralized ionomers. For purposes of the present disclosure, "HNP" refers to an acid copolymer after at least 70 percent of all acid groups present in the composition are neutralized.

Preferred ionomers are salts of O/X- and O/X/Y-type acid copolymers, wherein O is an α-olefin, X is a $C_3$-$C_8$ α, β-ethylenically unsaturated carboxylic acid, and Y is a softening monomer. O is preferably selected from ethylene and propylene. X is preferably selected from methacrylic acid, acrylic acid, ethacrylic acid, crotonic acid, and itaconic acid. Methacrylic acid and acrylic acid are particularly preferred. Y is preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate.

Preferred O/X and O/X/Y-type copolymers include, without limitation, ethylene acid copolymers, such as ethylene/(meth)acrylic acid, ethylene/(meth)acrylic acid/maleic anhydride, ethylene/(meth)acrylic acid/maleic acid mono-ester, ethylene/maleic acid, ethylene/maleic acid mono-ester, ethylene/(meth)acrylic acid/n-butyl (meth)acrylate, ethylene/(meth)acrylic acid/iso-butyl (meth)acrylate, ethylene/(meth)acrylic acid/methyl (meth)acrylate, ethylene/(meth) acrylic acid/ethyl (meth)acrylate terpolymers, and the like. The term, "copolymer," as used herein, includes polymers having two types of monomers, those having three types of monomers, and those having more than three types of monomers. Preferred α, β-ethylenically unsaturated mono- or dicarboxylic acids are (meth) acrylic acid, ethacrylic acid, maleic acid, crotonic acid, fumaric acid, itaconic acid. (Meth) acrylic acid is most preferred. As used herein, "(meth) acrylic acid" means methacrylic acid and/or acrylic acid. Likewise, "(meth) acrylate" means methacrylate and/or acrylate.

In a particularly preferred version, highly neutralized E/X- and E/X/Y-type acid copolymers, wherein E is ethylene, X is a $C_3$-$C_8$ α, β-ethylenically unsaturated carboxylic acid, and Y is a softening monomer are used. X is preferably selected from methacrylic acid, acrylic acid, ethacrylic acid, crotonic acid, and itaconic acid. Methacrylic acid and acrylic acid are particularly preferred. Y is preferably an acrylate selected from alkyl acrylates and aryl acrylates and preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate. Preferred E/X/Y-type copolymers are those wherein X is (meth) acrylic acid and/or Y is selected from (meth) acrylate, n-butyl (meth) acrylate, isobutyl (meth) acrylate, methyl (meth) acrylate, and ethyl (meth) acrylate. More preferred E/X/Y-type copolymers are ethylene/(meth) acrylic acid/n-butyl acrylate, ethylene/(meth) acrylic acid/methyl acrylate, and ethylene/(meth) acrylic acid/ethyl acrylate.

The amount of ethylene in the acid copolymer may be at least about 15 weight percent, at least about 25 weight percent, at least about 40 weight percent, or at least about 60 weight percent, based on total weight of the copolymer. The amount of $C_3$ to $C_8$ α, β-ethylenically unsaturated mono- or dicarboxylic acid in the acid copolymer is typically from 1 weight percent to 35 weight percent, from 5 weight percent to 30 weight percent, from 5 weight percent to 25 weight percent, or from 10 weight percent to 20 weight percent, based on total weight of the copolymer. The amount of optional softening comonomer in the acid copolymer may be from 0 weight percent to 50 weight percent, from 5 weight percent to 40 weight percent, from 10 weight percent to 35 weight percent, or from 20 weight percent to 30 weight percent, based on total weight of the copolymer.

The various O/X, E/X, O/X/Y, and E/X/Y-type copolymers are at least partially neutralized with a cation source, optionally in the presence of a high molecular weight organic acid, such as those disclosed in U.S. Pat. No. 6,756,436, the entire disclosure of which is hereby incorporated herein by reference. The acid copolymer can be reacted with the optional high molecular weight organic acid and the cation source simultaneously, or prior to the addition of the cation source. Suitable cation sources include, but are not limited to, metal ion sources, such as compounds of alkali metals, alkaline earth metals, transition metals, and rare earth elements; ammonium salts and monoamine salts; and combinations thereof. Preferred cation sources are compounds of magnesium, sodium, potassium, cesium, calcium, barium, manganese, copper, zinc, lead, tin, aluminum, nickel, chromium, lithium, and rare earth metals. The amount of cation used in the composition is readily determined based on desired level of neutralization. As discussed above, for HNP compositions, the acid groups are neutralized to 70 percent or greater, 70 to 100 percent, or 90 to 100 percent. In one embodiment, an excess amount of neutralizing agent, that is, an amount greater than the stoichiometric amount needed to neutralize the acid groups, may be used. That is, the acid groups may be neutralized to 100 percent or greater, for example 110 percent or 120 percent or greater. In other embodiments, partially-neutralized compositions are prepared, wherein 10 percent or greater, normally 30 percent or greater of the acid groups are neutralized. When aluminum is used as the cation source, it is preferably used at low levels with another cation such as zinc, sodium, or lithium, since aluminum has a dramatic effect on melt flow reduction and cannot be used alone at high levels. For example, aluminum is used to neutralize about 10 percent of the acid groups and sodium is added to neutralize an additional 90 percent of the acid groups.

"Low acid" and "high acid" ionomeric polymers, as well as blends of such ionomers, may be used. In general, low acid ionomers are considered to be those containing 16 weight percent or less of acid moieties, whereas high acid ionomers are considered to be those containing greater than 16 weight percent of acid moieties. In one embodiment, the inner cover layer is formed from a composition comprising a high acid ionomer. A suitable high acid ionomer is Surlyn® 8150. (DuPont), which is a copolymer of ethylene and methacrylic acid, having an acid content of 19 weight percent, 45 percent neutralized with sodium. In another embodiment, the inner cover layer is formed from a composition comprising a high acid ionomer and a maleic anhydride-grafted non-ionomeric polymer. An example of a suitable maleic anhydride-grafted polymer is Fusabond® 525D (DuPont), which is a maleic anhydride-grafted, metallocene-catalyzed ethylene-butene copolymer having about 0.9 weight percent maleic anhydride grafted onto the copolymer. Blends of high acid ionomers with maleic anhydride-grafted polymers are further disclosed, for example, in U.S. Pat. Nos. 6,992,135 and 6,677,401, the entire disclosures of which are hereby incorporated herein by reference.

The inner cover layer also may be formed from a composition comprising a 50/45/5 blend of Surlyn® 8940/Surlyn® 9650/Nucrel® 960. In this aspect, the composition may have a material hardness of from 80 to 85 Shore C. In another embodiment, the inner cover layer is formed from a composition comprising a 50/25/25 blend of Surlyn® 8940/Surlyn® 9650/Surlyn® 9910, having a material hardness of about 85 to 95 Shore C. In yet another embodiment, the inner cover layer is formed from a composition comprising a 50/50 blend of Surlyn® 8940/Surlyn® 9650, having a material hardness of about 82 to 90 Shore C. A composition comprising a 50/50 blend of Surlyn® 8940 and Surlyn® 7940 also may be used.

The compositions used to make the layers outside of the core assemblage, e.g., the inner cover and outer cover layers, may contain a variety of fillers and additives to impart specific properties to the ball. For example, relatively heavy-weight and light-weight metal fillers such as, particulate; powders; flakes; and fibers of copper, steel, brass, tungsten, titanium, aluminum, magnesium, molybdenum, cobalt, nickel, iron, lead, tin, zinc, barium, bismuth, bronze, silver, gold, and platinum, and alloys and combinations thereof may be used to adjust the specific gravity of the ball. Other additives and fillers include, but are not limited to, optical brighteners, coloring agents, fluorescent agents, whitening agents, UV absorbers, light stabilizers, surfactants, processing aids, antioxidants, stabilizers, softening agents, fragrance components, plasticizers, impact modifiers, titanium dioxide, clay, mica, talc, glass flakes, milled glass, and mixtures thereof.

The outer cover layer preferably has a material hardness of 85 Shore C or less. The thickness of the outer cover layer is preferably within a range having a lower limit of 0.010 or 0.015 or 0.025 inches and an upper limit of 0.035 or 0.040 or 0.055 or 0.080 inches. Methods for measuring hardness of the layers in the golf ball are described in further detail herein. When included, the inner cover layer preferably has a material hardness within a range having a lower limit of 70 or 75 or 80 or 82 Shore C and an upper limit of 85 or 86 or 90 or 92 Shore C. The thickness of the intermediate layer is preferably within a range having a lower limit of 0.010 or 0.015 or 0.020 or 0.030 inches and an upper limit of 0.035 or 0.045 or 0.080 or 0.120 inches.

In one embodiment, the golf balls made in accordance with the present disclosure include a core assemblage as described herein, an inner cover layer formed from an ionomeric material, and the outer cover layer is formed from a polyurethane material, and the outer cover layer has a hardness that is less than that of the inner cover layer. For example, the inner cover layer may have a hardness of greater than about 60 Shore D and the outer cover layer may have a hardness of less than about 60 Shore D. In an alternative embodiment, the inner cover layer is comprised of a partially or fully neutralized ionomer, a thermoplastic polyester elastomer, a thermoplastic polyether block amide, or a thermoplastic or thermosetting polyurethane or polyurea, and the outer cover layer is comprised of an ionomeric material. In this alternative embodiment, the inner cover layer may have a hardness of less than about 60 Shore D and the outer cover layer may have a hardness of greater than about 55 Shore D and the inner cover layer hardness is less than the outer cover layer hardness.

When a dual cover is disposed about the core assemblage, the inner cover layer may have a thickness of about 0.01 inches to about 0.06 inches, about 0.015 inches to about 0.040 inches, or about 0.02 inches to about 0.035 inches. The outer cover layer may have a thickness of about 0.015 inches to about 0.055 inches, about 0.02 inches to about 0.04 inches, or about 0.025 inches to about 0.035 inches.

The golf balls of the present disclosure may be formed using a variety of application techniques. For example, the golf ball layers may be formed using compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials. In this aspect, cover layers may be formed over the core assemblage using any suitable technique that is associated with the material used to form the layer. Preferably, each cover layer is separately formed over the core assemblage. For example, an ethylene acid copolymer ionomer composition may be injection-molded to produce half-shells over the core assemblage. Alternatively, the ionomer composition can be placed into a compression mold and molded under sufficient pressure, temperature, and time to produce the hemispherical shells, which may then be placed around the core assemblage in a compression mold. An outer cover layer including a polyurethane or polyurea composition over the ball sub-assembly may be formed by using a casting process.

Golf balls made in accordance with the present disclosure may be subjected to finishing steps such as flash-trimming, surface-treatment, marking, coating, and the like using techniques known in the art. In one embodiment, a white-pigmented cover may be surface-treated using a suitable method such as, for example, corona, plasma, or ultraviolet (UV) light-treatment. Indicia such as trademarks, symbols, logos, letters, and the like may be printed on the cover using pad-printing, ink-jet printing, dye-sublimation, or other suitable printing methods. Clear surface coatings (for example, primer and top-coats), which may contain a fluorescent whitening agent, may be applied to the cover. Golf balls may also be painted with one or more paint coatings in a variety of colors. In one embodiment, white primer paint is applied first to the surface of the ball and then a white top-coat of paint may be applied over the primer.

Aerodynamic Characteristics

Golf ball spin rate is the amount of spin on the golf ball once the ball is hit and separates from the clubface of the golf club. Spin rate is measured by RPM (revolutions per minute). As described above, the golf balls of the present disclosure combine a core assemblage with a positive hardness and compression gradient with a cover to achieve a reduction in the driver spin rate when compared to a "conventional golf ball". For the purposes of this disclosure, the "conventional golf ball" used for comparison purposes includes either a three-piece golf ball with a polybutadiene core, an inner cover layer formed from ionomer, and a polyurethane outer cover or a four-piece golf ball with a dual polybutadiene core, an ionomer inner cover layer, and a polyurethane outer cover. In particular, for this spin rate comparison exercise, the inner cover and outer cover of the conventional golf ball are the same or substantially the same as the inner and outer cover layers of a golf ball of the present disclosure. In other words, the only variation between the conventional golf ball and the golf ball made according to the present disclosure (for the purposes of this spin rate comparison exercise) is the core assemblage.

In this vein, the specific core assemblage disclosed herein helps to reduce the spin rate of the golf ball when hit with a driver while also providing the desired short game performance associated with multi-layer high spin golf balls. In one embodiment, the spin rate of the golf balls of the present disclosure is reduced by about 2 percent to about 8 percent when compared to a conventional golf ball (with all other factors including swing speed held constant). In another embodiment, the spin rate of the golf balls of the present disclosure is reduced by about 3 percent to about 7 percent when compared to a conventional golf ball (with all other factors held constant). In another embodiment, the spin rate of the golf balls of the present disclosure is reduced by about 4 percent to about 6 percent when compared to a conventional golf ball (with all other factors held constant).

For example, if the average spin rate of a conventional golf ball off of a driver is about 2700 rpm, the spin rate of the golf balls of the present disclosure are about 50 to about 220 rpm less, i.e., about 2480 to about 2650 rpm (all other factors held constant). In one embodiment, the spin rate of the golf balls of the present disclosure are about 80 to about 190 rpm less than the spin rate of a conventional golf ball off of a driver (all other factors held constant). In yet another embodiment, the spin rate of the golf balls of the present disclosure are about 100 to about 160 rpm less than the spin rate of a conventional golf ball off of a driver (all other factors held constant).

In one embodiment, the driver spin rate of a golf ball made according to the present disclosure ranges from about 2000 rpm to about 3500 rpm. In another embodiment, the driver spin rate is about 2200 rpm to about 3000 rpm. In yet another embodiment, the driver spin rate is about 2350 to about 2650 rpm.

In other embodiments, the golf balls made in accordance with the present disclosure achieve a reduction in overall distance of at least about 10 yards when compared to a conventional golf ball. In another embodiment, a golf ball of the present invention achieves a reduction in overall distance of at least about 15 yards when compared to a similar conventional golf ball. In still another embodiment, a golf ball of the present invention achieves a reduction in overall distance of at least about 20 yards when compared to a similar conventional golf ball. In yet another embodiment, a golf ball of the present invention achieves a reduction in overall distance of about 25 yards when compared to a similar conventional golf ball.

EXAMPLES

The following prophetic examples describe core assemblages that can be made in accordance with this invention.

The rubber formulations for each of the center, inner core layer, and outer core layer include polybutadiene as the base rubber. The amount of co-agent, which in these examples is ZDA, is provided in parts by weight per 100 parts of base rubber. The properties of the core assemblies are described in below Table 1. Hardness of the center is the surface of the center.

TABLE 1

| | Core Assemblages | | | | | | | | | | | |
|---|---|---|---|---|---|---|---|---|---|---|---|---|
| | Center | | | | Inner Core Layer | | | | Outer Core Layer | | | |
| | Co-Agent (pbw) | Surface Hardness (Shore C) | Compression (SCDI) | Diameter (in) | Co-Agent (pbw) | Surface Hardness (Shore C) | Compression (SCDI) | Diameter (in) | Co-Agent (pbw) | Surface Hardness (Shore C) | Compression (SCDI) | Diameter (in) |
| A | 15 | 60 | 60 | 0.75 | 21 | 70 | 130 | 1.25 | 31 | 85 | 210 | 1.50 |
| B | 20 | 65 | 70 | 0.75 | 25 | 80 | 135 | 1.25 | 35 | 90 | 220 | 1.50 |
| C | 25 | 70 | 75 | 1.0 | 28 | 85 | 140 | 1.13 | 38 | 95 | 230 | 1.55 |
| D | 28 | 75 | 78 | 1.0 | 30 | 90 | 145 | 1.13 | 40 | 100 | 240 | 1.55 |

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

The terms "first," "second," and the like are used to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the disclosure. Likewise, terms like "top" and "bottom"; "front" and "back"; and "left" and "right" are used to distinguish certain features or elements from each other, but it is expressly contemplated that a top could be a bottom, and vice versa.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

What is claimed is:

1. A golf ball, comprising:

a core assemblage comprising:

a center having a surface hardness $H_1$, a diameter $D_1$, and a SCDI compression $C_1$, wherein the center comprises a first rubber formulation comprising a first amount of co-agent;

an inner core layer disposed about the center and having a surface hardness $H_2$, a diameter $D_2$, and a SCDI compression $C_2$, wherein $H_1$ is about 60 percent to about 90 percent of $H_2$ and Cis about 25 percent to about 60 percent of $C_2$, wherein the inner core layer comprises a second rubber formulation comprising a second amount of co-agent, and wherein the first amount is about 30 to about 70 percent of the second amount; and an outer core layer disposed about the inner core layer and having a surface hardness $H_3$, a diameter $D_3$, and a SCDI compression $C_3$, wherein $H_2$ is about 60 percent to about 90 percent of $H_3$ and $C_2$ is about 40 percent to about 80 percent of $C_3$, wherein the outer core layer comprises a third rubber formulation comprising a third amount of co-agent, wherein the second amount is about 50 to 75 percent of the third amount, and wherein $$0.1 \leq \frac{CA_C}{1 - \frac{1}{CGr_{SCDI}}} \leq 0.2$$

where $CA_C$ represents the weight percent of the first amount in decimal form based on 100 parts of base rubber in the first rubber formulation, and $CA_C \leq 0.2$; and $CGr_{SCDI}$ represents a compression gradient (SCDI) of the core assemblage;

an intermediate layer disposed about the core assemblage to form an intermediate ball; and a cover layer disposed about the intermediate ball.

2. The golf ball of claim 1, wherein each of the first, second, and third rubber formulations comprise polybutadiene rubber, butyl rubber, or a blend thereof.

3. The golf ball of claim 1, wherein $D_1$ is about 60 percent to 80 percent of $D_2$ and $D_2$ is about 60 percent to about 80 percent of $D_3$.

4. The golf ball of claim 1, wherein the cover layer has a thickness in the range of about 0.010 to about 0.080 inches.

5. The golf ball of claim 4, wherein the cover layer comprises a material selected from the group consisting of polyurethanes, polyureas, and hybrids, copolymers, and blends thereof.

6. The golf ball of claim 1, wherein the intermediate layer comprises an ionomer material.

7. The golf ball of claim 1, wherein $H_1$ is in the range of about 60 to about 80 Shore C, $H_2$ is in the range of about 70 to about 90 Shore C, and $H_3$ is in the range of about 80 to about 100 Shore C to provide a positive hardness gradient from the center to the outer core layer.

8. The golf ball of claim 1, wherein the co-agent is one or more metal salts of acrylates, diacrylates, methacrylates, and dimethacrylates, and wherein the metal is selected from magnesium, calcium, zinc, aluminum, lithium, and nickel.

9. The golf ball of claim 1, wherein the first amount is about 45 to about 60 percent of the second amount and the second amount is about 60 to about 75 percent of the third amount.

10. A golf ball, comprising:

a core assemblage comprising:

a center having a surface hardness $H_1$, a diameter $D_1$, and a SCDI compression $C_1$, wherein the center comprises a first rubber formulation comprising a first amount of co-agent;

an inner core layer disposed about the center and having a surface hardness $H_2$, a diameter $D_2$, and a SCDI compression $C_2$, wherein the inner core layer comprises a second rubber formulation comprising a second amount of co-agent, wherein the first amount is about 30 to about 70 percent of the second amount; and an outer core layer disposed about the inner core layer and having a surface hardness $H_3$, a diameter $D_3$, and a SCDI compression $C_3$, wherein the outer core layer comprises a third rubber formulation comprising a third amount of co-agent, wherein the second amount is about 50 to 75 percent of the third amount, wherein $$0.1 \le \frac{CA_C}{1 - \frac{1}{CGr_{SCDI}}} \le 0.2$$

where $CA_C$ represents the weight percent of the first amount in decimal form based on 100 parts of base rubber in the first rubber formulation, and $CA_C \le 0.2$; and $CGr_{SCDI}$ represents a compression gradient (SCDI) of the core assemblage, and wherein $$0.20 \le \frac{CA_{IC}}{1 - \frac{1}{CGr_{SCDI}}} \le 0.2$$

where $CA_{IC}$ represents the weight percent of the second amount in decimal form based on 100 parts of base rubber in the second rubber formulation, and $CA_{IC} \le 0.3$;

an intermediate layer disposed about the core assemblage to form an intermediate ball; and a cover layer disposed about the intermediate ball.

11. The golf ball of claim 10, wherein $H_1$ is in the range of about 60 to about 80 Shore C, $H_2$ is in the range of about 70 to about 90 Shore C, and $H_3$ is in the range of about 80 to about 100 Shore C to provide a positive hardness gradient from the center to the outer core layer.

12. The golf ball of claim 10, wherein $$0.15 \le \frac{\frac{H_1}{H_3}}{\frac{C_3}{C_1}} \le 0.35.$$

13. The golf ball of claim 10, wherein the co-agent is one or more metal salts of acrylates, diacrylates, methacrylates, and dimethacrylates, and wherein the metal is selected from magnesium, calcium, zinc, aluminum, lithium, and nickel.

14. The golf ball of claim 10, wherein the first amount is about 33 to about 67 percent of the second amount and the second amount is about 60 to about 75 percent of the third amount.

15. A golf ball, comprising:

a core assemblage comprising:

a center having a surface hardness $H_1$, a diameter $D_1$, and a SCDI compression $C_1$, wherein the center comprises a first rubber formulation comprising a first amount of co-agent;

an inner core layer disposed about the center having a surface hardness $H_2$, a diameter $D_2$, and a SCDI compression $C_2$, wherein $C_1$ is about 30 percent to about 60 percent of $C_2$, wherein the inner core layer comprises a second rubber formulation comprising a second amount of co-agent, and wherein the first amount is about 30 to about 70 percent of the second amount; and an outer core layer disposed about the inner core layer and having a surface hardness $H_3$, a diameter $D_3$, and a SCDI compression $C_3$, wherein the outer core layer comprises a third rubber formulation comprising a third amount of co-agent, wherein the second amount is about 50 to 75 percent of the third amount, wherein $C_2$ is about 50 percent to about 80 percent of $C_3$, wherein $$0.1 \le \frac{CA_C}{1 - \frac{1}{CGr_{SCDI}}} \le 0.2$$

where $CA_C$ represents the weight percent of the first amount in decimal form based on 100 parts of base rubber in the first rubber formulation, and $CA_C \le 0.2$; and $CGr_{SCDI}$ represents a compression gradient (SCDI) of the core assemblage, and wherein $$\frac{1}{2(H_1 + H_2)} > \frac{1}{3}(H_1 + H_3) \text{ and } \frac{1}{2(H_1 + H_2)} > \frac{1}{3}(H_2 + H_3);$$

an intermediate layer disposed about the core assemblage to form an intermediate ball; and a cover layer disposed about the intermediate ball.

16. The golf ball of claim 15, wherein $H_1$ is in the range of about 60 to about 80 Shore C, $H_2$ is in the range of about 70 to about 90 Shore C, and $H_3$ is in the range of about 80 to about 100 Shore C to provide a positive hardness gradient from the center to the outer core layer.

17. The golf ball of claim 15, wherein the cover layer comprises a material selected from the group consisting of polyurethanes, polyureas, and hybrids, copolymers, and blends thereof.

18. The golf ball of claim 15, wherein the intermediate layer comprises an ionomer material.

19. The golf ball of claim 15, wherein the co-agent is one or more metal salts of acrylates, diacrylates, methacrylates, and dimethacrylates, and wherein the metal is selected from magnesium, calcium, zinc, aluminum, lithium, and nickel.

20. The golf ball of claim 15, wherein the first amount is about 45 to about 60 percent of the second amount and the second amount is about 60 to about 75 percent of the third amount.

* * * * *